US006306276B1

(12) United States Patent
Nobe et al.

(10) Patent No.: US 6,306,276 B1
(45) Date of Patent: Oct. 23, 2001

(54) AQUEOUS ELECTRODEPOSITION OF RARE EARTH AND TRANSITION METALS

(76) Inventors: Ken Nobe, 1112 Kagawa St., Pacific Palisades, CA (US) 90272; Morton Schwartz, 3017 Oakhurst ave., Los Angeles, CA (US) 90034; Linlin Chen, 121 Hawthorne Ave. #8, Kalispell, MI (US) 59901; No Sang Myung, 12791 Louise St., Garden Grove, CA (US) 92841

( * ) Notice: Subject to any disclaimer, the term of this patent is extended or adjusted under 35 U.S.C. 154(b) by 0 days.

(21) Appl. No.: 09/319,632

(22) PCT Filed: Oct. 7, 1998

(86) PCT No.: PCT/US98/21103

§ 371 Date: Dec. 10, 1999

§ 102(e) Date: Dec. 10, 1999

(87) PCT Pub. No.: WO99/18265

PCT Pub. Date: Apr. 15, 1999

Related U.S. Application Data

(60) Provisional application No. 60/062,667, filed on Oct. 8, 1997.

(51) Int. Cl.[7] ..... C25D 3/56; C25D 3/12; C25D 3/20; C25D 3/00

(52) U.S. Cl. ..... 205/238; 205/261; 205/270; 205/271; 205/269

(58) Field of Search ..... 205/261, 269, 205/270, 271

(56) References Cited

U.S. PATENT DOCUMENTS

| | | | | |
|---|---|---|---|---|
| 3,914,160 | | 10/1975 | Fueki et al. | 204/43 S |
| 3,947,331 | | 3/1976 | Kinh et al. | 204/37 R |
| 4,101,311 | * | 7/1978 | Aonuma et al. | 78/0.5 |
| 4,101,388 | * | 7/1978 | Chessin et al. | 204/43 T |
| 4,410,454 | | 10/1983 | Faschingbauer | 502/306 |
| 4,444,629 | | 4/1984 | Martin | 204/43 Z |
| 4,529,668 | | 7/1985 | Croopnick et al. | 428/665 |
| 4,741,818 | | 5/1988 | Nobel et al. | 204/44.2 |
| 4,846,942 | * | 7/1989 | Watanabe et al. | 204/58.5 |
| 4,952,557 | | 8/1990 | Schmidt | 505/1 |
| 5,302,464 | * | 4/1994 | Nomura et al. | 428/551 |
| 5,470,820 | * | 11/1995 | Hauser et al. | 505/472 |

OTHER PUBLICATIONS

Chen, et al. "Aqueous Electrodeposition of Rare Earth Thin Film Alloys with Ferrous Metals," Chemical Abstracts, vol. 126, No. 22, Jun. 2, 1997, doc. XP002099433.

Liu, et al. "Study on the Co–Electrodeposition of Lanthanum with Nickel," Chemical Abstracts, vol. 124, No. 6, Feb. 5, 1996, doc. XP002099434.

* cited by examiner

*Primary Examiner*—Donald R. Valentine
*Assistant Examiner*—Erica Smith-Hicks

(57) ABSTRACT

The present invention relates to the electrodeposition of transition metal and rare earth alloys from aqueous solutions to form thin films. The present invention which comprises the preparation of suitable mixtures of water soluble compounds containing the desired transition metal (TM) and rare earth (RE) elements, establishing appropriate bath conditions and applying specific current densities across the bath solution to cause a film with the desired properties to be deposited on a target substrate.

20 Claims, 6 Drawing Sheets

Effect of pH and current density on Nd-Ni(a), Fe(b), Co(c) deposits. Bath B, unstirred solution.

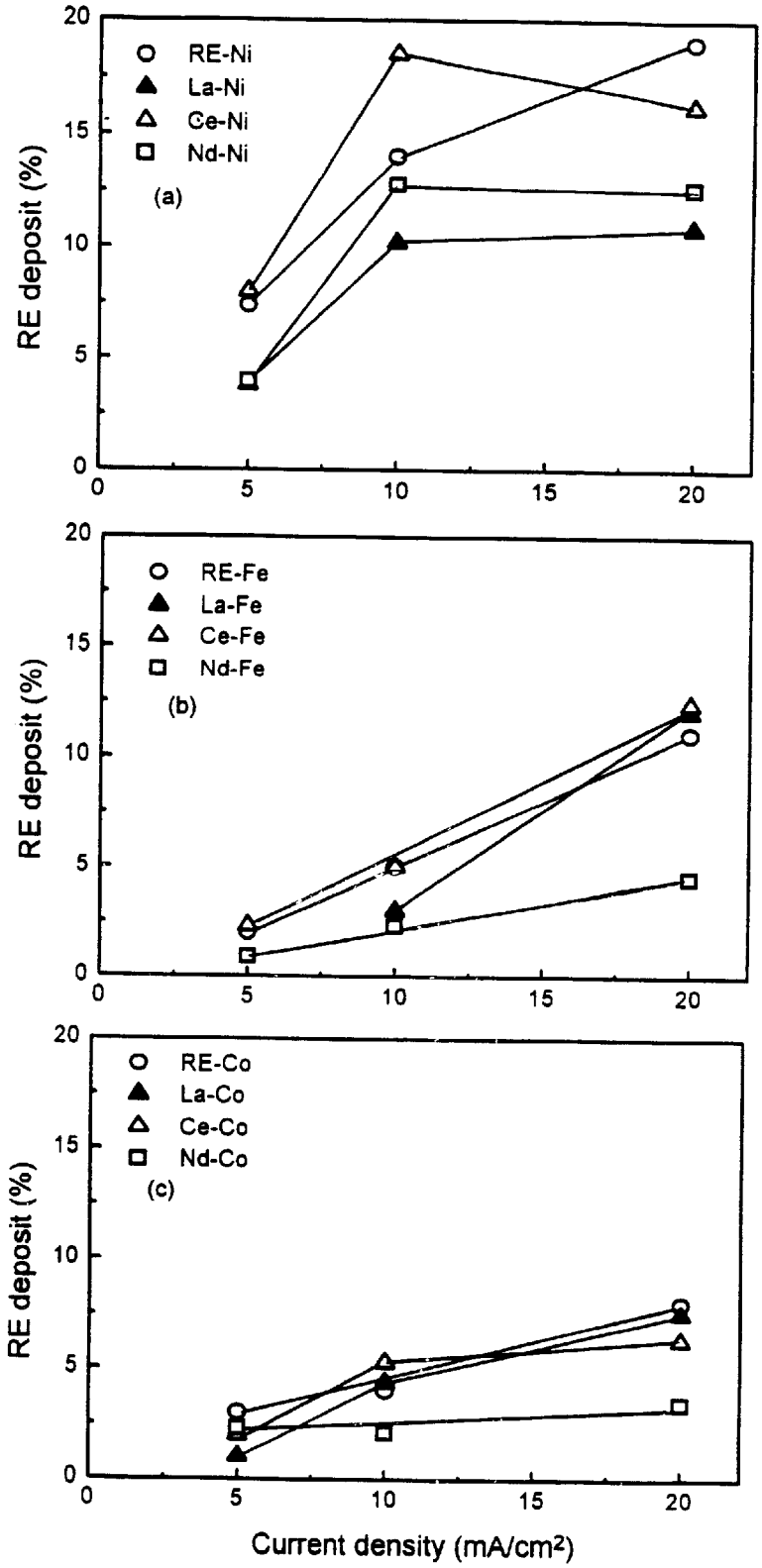
Fig.1. Effect of current density on RE and RE mixture - Ni(a), Fe(b), Co(c) deposits. Bath A(pH4). Oscillatory stirring of solution (48 cycles/min.)

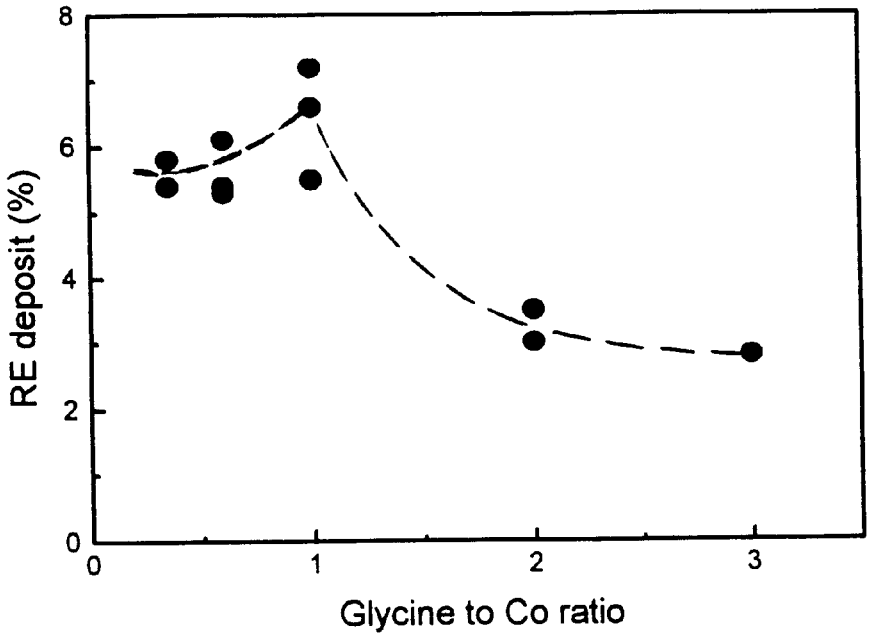
Fig.2. Effect of glycine/Co ratio on rare earth mixture-Co deposits, Bath A(pH4), Magnetic stirrer.

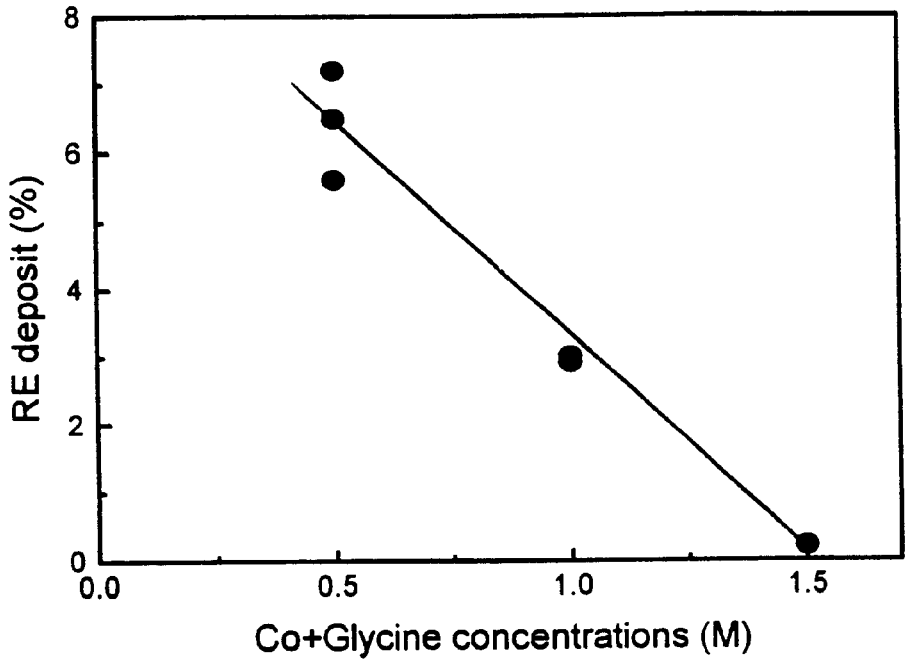
Fig.3. Effect of glycine and cobalt concentrations at constant glycine:Co ratio of 3:1 on rare earth mixture-Co deposits. Bath A (pH4), magnetic stirrer.

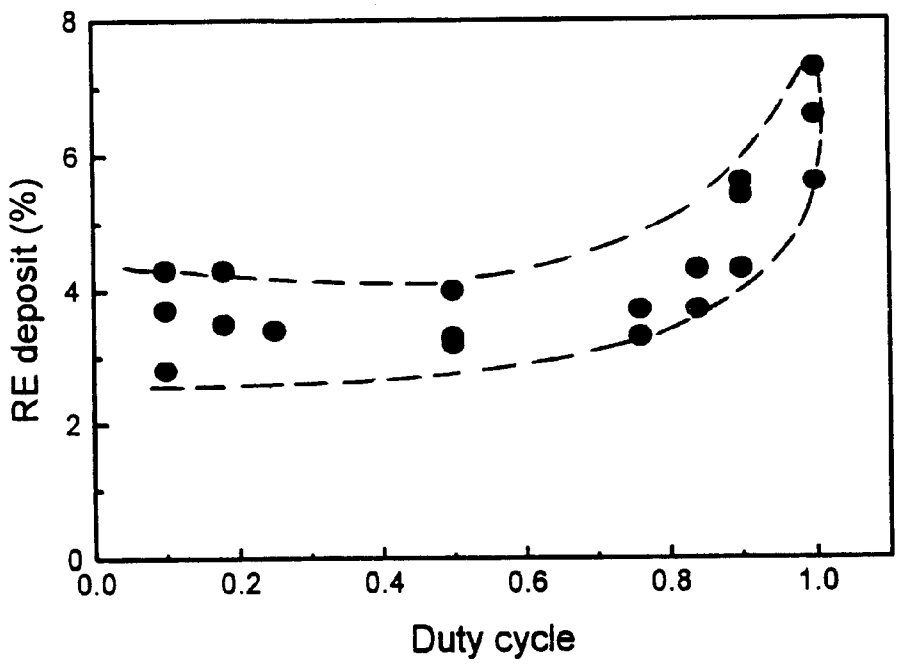
Fig.4. Effect of pulse current duty cycle at average current density of 20mA/cm$^2$ on rare earth mixture-Co deposits. Bath A (pH4), magnetic stirrer.

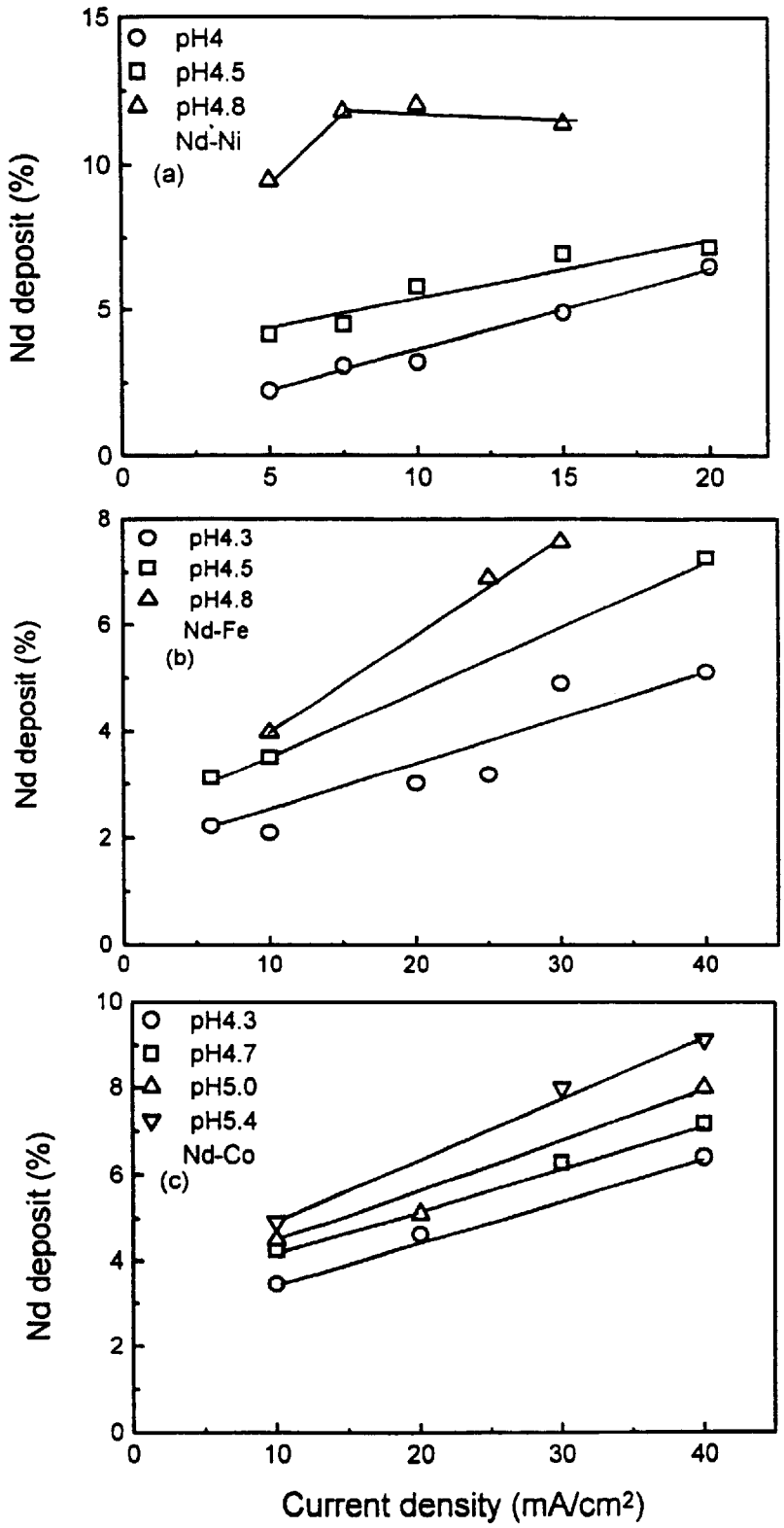
Fig.5. Effect of pH and current density on Nd-Ni(a), Fe(b), Co(c) deposits. Bath B, unstirred solution.

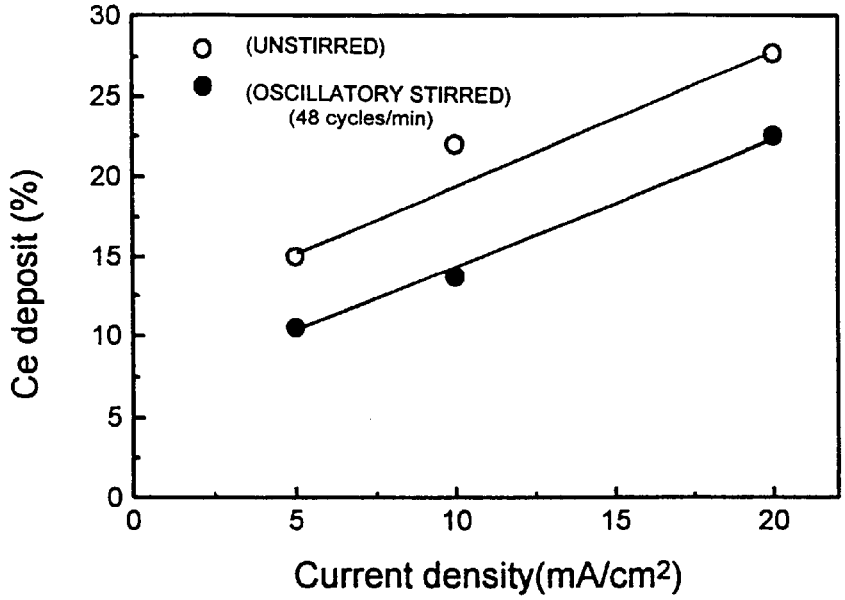
Fig.6. Effect of solution stirring on Ce-Ni deposits. Bath B(pH4).
Open points -- unstirred solution; Solid points -- oscillatory stirring(48cycles/min)

AQUEOUS ELECTRODEPOSITION OF RARE EARTH AND TRANSITION METALS

This application claims the benefit of prior U.S. Provisional Application Ser. No. 60/062,667, filed Oct. 8, 1997.

BACKGROUND OF THE INVENTION

The present invention relates to the electrodeposition of transition metal and rare earth alloys from aqueous solutions to form thin films. In particular, this invention relates to the application of an aqueous based electrodeposition process for producing magneto-optical systems and permanent magnets.

Bulk alloys of transition metals-rare earths are important permanent magnet materials. There have been considerable recent efforts to develop new high performance magnets that achieve substantial weight and size reductions when compared to traditional permanent magnets used in electrical devices. Recent developments have focussed on cobalt-rare earth and, more recently, on iron-rare earth permanent magnets. Substantially improved magnetic properties have been achieved by appropriate heat treatment of these new alloys.

Sputtered thin films of binary, ternary and quaternary transition metal-rare earth alloys have recently been utilized as magneto-optical reading media.

Therefore, there is a need for an electrochemical process capable of depositing thin films of Fe, Ni and Co-rare earth alloys which would substantially reduce the manufacturing costs of these alloys compared to vacuum processes. Furthermore, electrodeposition of Co, Ni and Fe-rare earth thin film alloys will enable fabrication of nano-dimensional permanent magnet and magneto-optical materials. In addition, ultra-high frequency electrodeposition techniques and addition of light elements show exceptional promise to produce nano-structured amorphous permanent magnet and magneto-optical systems.

SUMMARY

These needs are met by the present invention which comprises the preparation of suitable mixtures of water soluble compounds containing the desired transition metal (TM) and rare earth (RE) elements, establishing appropriate bath conditions and applying specific current densities across the bath solution to cause a film with the desired properties to be deposited on a target substrate.

A number of plating solutions consisting of mixtures of ferrous, cobalt, nickel, lanthanum, neodymium and cerium salts, as well as other rare earth salts were prepared. Under certain current density and bath conditions mirror-bright metallic films were deposited on substrates.

BACKGROUND

Rare earth-transition metal alloys, such as $Nd_2Fe_{14}B$ and solid solution of interstitial N and C atoms in $Sm_2Fe_{17}$, have coercivities, remanances and energy product greater than prior state of the art compositions. The makes them promising materials for high powered permanent magnets used in automotive, aerospace, information technology and consumer electronic industries.

In 1973, P. Chaudhari, J. J. Cuomo and R. J. Cambino, IBM J. Res. Develop., 17, 66 (1973) discovered that sputtered Gd—Co and Gd—Fe thin films have perpendicular magnetic anisotropy, which resulted from antiferromagnetic coupling between Gd and Co or Fe atoms. Since then, rare earth-transition metal (RE-TM) thin films have been prepared by various vacuum deposition processes to investigate the electrical and magnetic properties of these films. These include binary Gd—Fe, Gd—Co, Tb—Co, Tb—Fe (Y. Mimura and N. Imamura, Appl. Phys. Lett., 28, 746 (1976), Y. Sakurai and K. Onishi, J. Magn. Magn. Mat., 35, 183 (1983), A. Forkl, H. Herscher, T. Mizoguchi, H. Kronmuller and H-U. Haberometer, J. Magn. Magn. Mat., 93, 261 (1991)), ternary Gd—Tb—Fe (M. Takahashi, T. Niharra and N. Ohta, J. Appl. Phys., 64,262 (1988), P. Hansen and K. Witter, IEEE Trans. Mag., MAG-24, 2317 (1988), Dy—Fe—Co (P. Hansen, S. Klahn, C. Clausen, G. Much and K. Kitter, J. Appl. Phys., 69, 3196 (1991); K. Naito, T. Numata, K. Nakashima and Y. Namba, J. Magn. Magn. Mat., 104, 1025 (1992), Tb—Fe—Co (M. M. Yang and T. M. Reith, J. Appl. Phys., 71, 3945 (1992) and quaternary GdTbFeCo J. F. Qui, K. N. R. Taylor and G. J. Russell, Mat. Res. Bull., 28, 67 (1993). RE-TM films exhibit strong temperature dependence of coercivity, i.e., higher coercivity at lower temperatures and lower coercivity at higher temperatures. This unique magnetic property makes them ideal candidates for high density storage media in magnetic-optical recording applications (M. H. Kryder, J. Magn. Magn. Mat., 83, 1 (1990); P. Hansen, J. Magn. Magn. Mat., 83, 6 (1990).

Electrodeposition of metallic thin films is usually more cost effective then vacuum deposition. However, prior attempts to electrodeposit RE-TM films has been limited to non-aqueous solutions (ie., water insoluble compounds in organic solvents). Moeller and Zimmerman reported the non-aqueous electrodeposition of rare earth metals of yttrium, neodymium and lanthanum and found that successful deposition could be obtained from ethylenediamine, a highly basic solvent (T. Moeller and P. A. Zimmerman, Science, 120, 539 (1954). Usuzaka et al. electrodeposition Co—Gd alloys from a formamide solution containing ethylenediamine as complexing agent. The resultant films were found to exhibit magnetic anisotropy perpendicular to the film surface (N. Usuzaka, H. Yamaguchi and T. Watanabe, Mat. Sci. Engr., 99, 105 (1988). Y. Sato, H. Ishida, K. Kobayakawa and Y. Abe, Chem. Lett., 1471 (1990), Y. Sato, T. Takazawa, M. Takahashi, H. Ishida and K. Kobayakawa, Plating and Surface Finishing, 4, 72 (1993) electrodeposited SM—Co alloys from formamide solutions and found that higher Co content in Sm—Co films exhibited higher saturation magnetization.

It is well known that rare earth metals are extremely basic metals with a reduction potential over −2V and electroplating of rare earth elements from aqueous solutions is believed to be unattainable due to the onset of hydrogen evolution. This is a common result of attempts to electrodeposit molybdenum or tungsten from aqueous solutions. However, numerous ferrous metal alloys with either Mo or W have been electrodeposited from aqueous solutions (L. O. Case and A. Krohn, J. Electrochem Soc., 105, 512 (1958); V. B. Singh, L. C. Singh and P. K. Tikoo, J. Electrochem. Soc., 127, 590 (1980); M. Schwartz, Unpublished Data (1946); also in discussions in Trans ECS, 94, 382–92 (1948); A. Brenner, P. Burkhead and E. Seegmiller, J. Res. NBS, 93, 351 (1947); M. L. Holt and L. E. Vaaler, Trans. ECS., 94, 50 (1948); W. E. Clark and M. L. Holt, ibid, 94, 244 (1948); M. H. Lietzke and M. L. Holt, ibid, 94, 252 (1948); W. H. Safranek and L. E. Vaaler, Plating, 46 (2), 133 (1959).

We have now discovered that the aqueous electrodeposition of ferrous metal-rare earth (RE) alloys is possible through selective use of added agents, such as complexing agents, current density, solution temperature, and pH.

DRAWINGS

These and other features, aspects and advantages of the present invention will become better understood with reference to the following description, appended claims, and accompanying drawings, where:

FIG. 1 is of graphs showing the effect of current density, with oscillatory stirring, on the co-deposition of rare earth TM alloyed with nickel, iron and cobalt respectively.

FIG. 2 is a graph showing the effect, with stirring, of glycine/cobalt ratio on the deposition of the rare earth cobalt mixture.

FIG. 3 is a graph showing the effect, with stirring, of glycine and cobalt concentration on rare earth cobalt mixture deposition.

FIG. 4 is a graph showing the effect, with stirring, of pulse current duty cycle on rare earth cobalt mixture deposition.

FIG. 5 is of graphs showing the effect of solution pH and current density on the deposition of Nd—Ni, Nd—FE and Nd—Co, respectively.

FIG. 6 is of graph showing the effect of solution stirring on Ce—Ni deposits.

DESCRIPTION

It has been discovered that rare earth and transition metal elements can be electroplated out of an aqueous solution to form bright metallic coatings on substrates by proper selection of the additives, such as complexing agent, solution pH, operating temperature, current density, complexing agent/metal ratio, complexing agent/transition metal ratio, and duty cycle. Particularly suitable complexing agents are glycine, alanine and serine which are all amino acids with a single carboxyl group. With the exception of cysteine, complexing agents evaluated which were not effective were amino acids with more than one carboxyl group or were not amino acids. Cysteine is an amino acid with one carboxyl group and a thio- group (—SH). The —SH apparently interfered with obtaining the desired result by causing the formation of hydroxides under the conditions evaluated.

While varying the operating conditions resulted in lesser concentrations of the desired materials in the films produced, conditions were still suitable for preparing RE containing coatings. The preferred complexing agent is glycine but other aminecarboxylates were also found to be effective. The preferred operating conditions were a current density of at least 5 mA/cm$^2$, room temperature, a pH of 4 and a Co/glycine ratio of about 0.3. However, it has been found that addition of $NH_4Cl$ to the processing bath sharply reduced hydrogen evolution resulting in higher RE content deposits. Furthermore, while a pH of 4 is preferred, metallic deposits were obtained over a wide pH range including pH less than 4 and greater than 7. Stable alkaline plating baths for RE and TM salts are disclosed.

Plating solutions were prepared containing various complexing agents, and transition metals (TM) (Co, Fe, ni) and rare earth chloride salts. The solution pH was adjusted upward with NaOH and lowered with HCl. Unless otherwise specified, electrodeposition was carried out at room temperature (RT) with DC current in the solutions containing $TMCl_2$ and La, Ce, Nd and a rare earth mixture (MOLYCORP™) referred to below as the REM mixture. Other commercial rare earth mixtures are also suitable. The composition of the Molycorp™ mixture is given in Table 1.

TABLE 1

| Rare Earth Mixture (Molycorp ™) | | | |
|---|---|---|---|
| Element | Analysis % as oxide | Equivalent % as carbonate | Wt. Percent Metal |
| Ce | 1.0 | 1.3 | 0.7 |
| La | 45.9 | 64.4 | 39.2 |
| Nd | 12.9 | 18.0 | 11.1 |
| Pr | 4.8 | 6.7 | 3.9 |
| Sm | 0.4 | 0.6 | 0.3 |
| Gd | 0.3 | 0.4 | 0.3 |
| Y | 0.3 | 0.5 | 0.2 |
| other RE | ~0.4 | ~0.6 | ~0.4 |
| other elements | ~0.1 | ~0.2 | — |

Primary test solutions were:

(A) Bath A—0.12M $TMCl_2$, 0.5M $B(OH)_3$, 0.36M complexing agent, 0.3 M RE or REM (B) Bath B—same as Bath A+1M $NH_4Cl$.

Solutions were either unstirred or stirred using a magnetic stirrer or by oscillatory stirring (48 cycles/min).

Each solution was used until accumulative exposure of 240-A-min/L at which point a new solution was prepared. The solution becomes less effective after 240-A-min/L because of consumption of the key ingredients in the rare earth mixture used.

Brass or stainless steel panels were used as substrates. The substrates were mechanically cleaned and then subjected to a chemical treatment including soaking in alkaline cleaning solution for 10 min followed by rinsing with deionized water. Surfaces were then activated just before electrodeposition by immersion in 10% HCl for 30 sec. Soluble Co, Fe, or Ni anodes were used, depending on the solution, to minimize changes in the metal solution composition and to avoid known side effects due to insoluble anodes.

A Kraft Dynatronix power supply (model DRP 20-5) was used to provide pulse current (PC) waveforms and a PAR potentiostate/galvanostat (model 173) was used to provide DC current.

In order to evaluate the efficiency of the electrodeposition of RE-TM materials from solutions containing complexing agents, nitric acid was used to dissolve the deposited films. After evaporating the nitric acid solution to dryness, the resultant dried RE-TM residue was dissolved with deionized water and transferred to a plastic test tube. Hydrofluoric acid was added to separate the rare earths from ferrous metals by precipitation of rare earths fluorides. The precipitate was thoroughly washed with deionized water and transferred to a 50 milliliter beaker. Boric acid and nitric acid were then added to dissolve the precipitated rare earth fluorides. The solution was evaporated to dryness, resulting in water-soluble rare earth compounds. The dried sample was redissolved with deionized water and transferred into a 10 milliliter volumetric flask. One milliliter of ammonium acetate buffer and a complexing agent (alizarin red) were added. Ammonium acetate was used to buffer the solution to pH of 4.7 and the alizarin red was complexed with the rare earth to develop a specific color. After dilution to 10 milliliters, a spectrophotometer ($\lambda$=530 nm) was used to measure the absorbance. The absorbance obtained was then used to estimate the amount of rare earth in the deposit.

For plating solutions free from complexing agents, precipitation by oxalic acid was followed by dissolution of the oxalate precipitate with concentrated hydrocholoric acid, and finally precipitation with ammonia. The final white hydroxide precipitate from the ammoniacal solutions confirmed the presence of lanthanons in the deposit.

Effects of Complexing Agents:

Using Bath A, eleven (11) complexing agents were investigated to study their effects on the production of RE-Co deposits and the stability of solutions. The solutions were stirred and exposed to current density of 20 mA/cm$^2$ unless. The results are summarized in Table 2.

TABLE 2

Effects of Complexing Agent*

| Additives | Rare Earth Content in Deposit | Appearance |
|---|---|---|
| Glycine (REM) | 8.0% | Bright metallic |
| Glycine (Ce) | 6.3% | Grey metallic |
| Glycine (La) | 7.5% | Black metallic |
| Glycine (Nd) | 3.4% | Gray metallic |
| Alanine (REM) | 3.8% | Bright metallic |
| Serine (REM) | 5.0% | Bright metallic |
| Aspartic acid (REM) | Not analyzed | Non-metallic white (RE) hydroxide |
| Glutamic acid (REM) | Not analyzed | Non-metallic white (RE) hydroxide |
| Malic acid (REM) | No RE | Grey metallic (pH 8.5) |
| Cysteine (REM) | Not analyzed | Non-metallic hydroxide |
| Glycolic acid (REM) | 0.2–1% | Bright metallic |
| Lactic acid (REM) | 0.2–1% | Bright metallic |
| EDTA (REM) | No deposit | |

*Solutions (Bath A, pH 4) were stirred and electrodeposition was at 20 mA/cm$^2$ It was found that the α-amino acids, glycine, alanine and serine stabilized the plating solution at pH 4, resulting in metallic deposits containing rare earths. The highest RE content in deposited films was obtained in solutions containing glycine while deposits of lower RE content were obtained with alaline and serine. All the deposits exhibited bright metallic appearance, which differed from the typical matte appearance of cobalt electrodeposits, indicating the effect of the rare earth elements. In order to test which element was preferentially deposited from the REM, separate runs were performed in the solutions containing glycine and $Ce(Cl)_3$, $Nd(Cl)_3$ or $La(Cl)_3$. The presence of lanthanum in the solution gave a black metallic deposit containing 7.5% lanthanum, 3.4% Nd was obtained with $NdCl_3$ and these $Ce(Cl_3)$ produced a gray metallic deposit with a 6.4% Ce in the films. In these cases, the 3 RE content of the deposit was lower than that when the RE mixture (8%) was used.

Solutions containing aspartic acid and glutamic acid were not stable and produced uniform white precipitates which consisted of RE hydroxides instead of metal films. Black deposits were obtained from the solutions containing cysteine and those cysteine solutions were also not stable.

The solutions containing glycolic acid or lactic acid were cloudy at pH4 due to the formation of small amounts of hydroxides. However, bright metallic deposits containing small amounts of RE were obtained from filtered solutions. EDTA formed strong complexes with Co. As a result, no deposits were obtained from the EDTA containing solutions.

In addition to the results shown in Table 2, a Nd—Ni deposit of 6% Nd was obtained from Bath B using ethylene diamine as a complexing agent. The solution (pH5) was unstirred and deposits were obtained at 15 m A/cm$^2$ Effect of Direct Current Deposition:

To evaluate the effect of current density on resultant deposits, electrodeposition was carried out at room temperature and current densities of 5, 10, and 20 mA/cm$^2$ for Co-RE, Ni-RE and Fe-RE solutions containing glycine at pH4. The solution contained 0.12M (Fe, Ni, Co) $Cl_2$, 0.5M $B(OH)_3$, 0.36M glycine and 0.3 RE (La, Ce, Nd), or REM. FIG. 1 compares the dependence of the rare earth content (% rare earth) of the deposited films at different current densities. Generally, the percentage of rare earth in the film increased with increasing current density. Deposit content of the rare earths were greater in Ni alloys, less in Fe alloys and least in Co alloys. As will be discussed below, rare earth deposit contents were greatest from unstirred solutions, a lesser amount from solutions mixed by oscillatory stirring and least from more vigorous agitation with a magnetic stirrer. Thus, mass transfer effects are clearly important in the efficacy of RE-TM electrodeposition.

Effect of Temperature:

Electrodeposition from magnetic stirred Bath A containing $CoCl_2$ and the rare earth mixture (REM) was run at both room temperature and 65° C. to examine the temperature dependence of Re-Co deposits. It was found that at the same current density (20 mA/cm$^2$), the are earth in the deposits at 65° C. was ~3% which was less than half the 6.6% obtained at room temperature. Thus, the cobalt deposition rate is greatly enhanced and the RE deposition reduced as temperature is increased. In other words, a lower temperature during electrodeposition favors RE deposition.

Effect of Complexing Agent to Metal Ratio:

The ratio of the glycine concentration to metal concentrations in magnetic stirred solutions also had a measurable effect on RE-Co electrodeposition. FIG. 2 shows the effects of glycine/Co solution ratios with $CoCl_2$ held constant at 0.12M on the deposit RE content obtained at room temperature with a current density of 20 mA/cm$^2$ and a pH of 4. There appears to be a plateau or an approach to a maximum in deposited RE content as the glycine/Co ratio approached 1. At glycine/Co ratio >1, a sharp decrease in the deposit RE content with increasing ratios was observed (FIG. 2).

Effect of $Co(Cl)_2$+Glycine:

In this study, the magnetic stirred solution RE concentration was maintained constant at 0.3M while the combined concentrations of $Co(Cl)_2$+glycine was increased at a constant ratio: 1Co:3glycine. FIG. 3 shows increased $Co(Cl)_2$+glycine concentrations resulted in decreased deposit RE content. At a combined total concentrations of 1.5M, practically no RE was deposited indicating the possible inhibitory-effect of increasing addition agent concentrations. Again, operating conditions were room temperature, pH of 4 and a current density of 20 mA/cm$^2$.

The duty cycle for PC electrodeposition is defined as $t_{on}/(t_{on}+t_{off})$, and the average current density is the peak current density times the duty cycle. Pulsed current deposition of RE-Co alloys was performed at an average current density of 20 mA/cm$^2$ with $T_{on}$ at 5 msec. FIG. 4 shows that the deposit RE content was fairly constant at ~4.5±5% at duty cycles from 0.1 to 0.8. In this range, the peak cathodic current densities ranged from 200 to 25 mA/cm$^2$, along with decreasing off-times of 45 to 1.75 msec, respectively. At duty cycles greater than 0.8, approaching DC plating, the deposit RE content increased to ~6.+1% and was similar to that obtained with constant DC current.

As the peak cathodic current density increased, the required longer off-times (relaxation times) permitted sufficient diffusion of either or both the Co or RE species into the cathode diffusion layer. However, at any peak cathodic current density greater than DC, the diffusion of the RE was insufficient to provide the necessary replenishment, resulting in lower deposit content, although the bulk solution concentration was three times that of cobalt. More Co deposited during the on-time indicating either fast deposition rates or mass transfer compared to the RE.

For Co-Re deposition, deposit RE content was relatively constant with PC deposition up to duty cycle of 0.8 and then increased at higher duty cycle. DC electrodeposition gave the highest amount of RE in the films. Temperatures greater than room temperature increased additive to metal ratio, and increased cobalt concentration resulted in lower RE in the films.

Effect of Solution pH and $NH_4Cl$:

The solution pH appears to be critical to the electrodeposition process. The pH can affect the onset of the hydrogen evolution reaction, the composition of the deposits, the current efficiencies and the stability of the solution. Addition of $NH_4Cl$ to Bath A was an effort to lessen the rate of hydrogen evolution. FIG. 5 illustrates the interdependence of current density with solution pH on the composition of deposits obtained from TM-Nd-glycine solutions. In general, the deposit Nd content increased fairly linearly with increasing current density and increasing solution pH in the range of 5–40 mA/sq.cm and pH4–5.4, respectively, the exception being Nd—Ni deposits which exhibited a maximum deposit content at 10 mA/sql.cm and solution pH of 4.8.

It was observed that the presence of $NH_4Cl$ significantly decreased hydrogen evolution during electrodeposition of RE-TM alloys. As a result the pH range to obtain metallic deposits was increased. For example, 29% Ce in Ce—Ni deposits were obtained with glycine @ pH2.7 and 15 mA/sq.cm (Bath B) and 23% Nd was obtained in Nd—Ni deposits with alanine @ pH7 and 20 mA/sq.cm (Bath B). Furthermore, deposit RE content was generally higher in solutions containing $NH_4Cl$. For example, for Ce—Ni deposits at 5 and 20 mA/cm$^2$ with oscillatory stirring (Bath B), Ce contents were 10.5% and 22.5%, respectively. In comparison 8.2% and 16.2% were obtained from Bath A.

Mass Transfer Effects:

The degree of solution agitation during electrodeposition of RE-TM alloys has a significant effect on the RE content of the deposits. FIG. 6 shows that the Ce content in Ce—Ni deposits was less from oscillatory stirred solutions (48 cycles/min) compared to unstirred solutions. Further, RE deposit contents were even lower from solutions agitated more vigorously using a magnetic stirrer. On the other hand, visual inspection of the deposits indicates that solution agitation improved the quality (appearance) of the deposits. For the electrodeposition of bright metallic or ferrous metal—RE alloys, the most effective complexing agents appear to include glycine, alanine and serine. These complexing agents are amino acids with a specific chemical structure, namely a single carboxyl group and thus differ chemically from the other sampled complexing agents which were not found to be suitable. Therefore, it would appear that other amino acids with single carboxyl groups would be suitable compounds to create the same result under similar operating conditions and solution compositions. Other types of complexing agents investigated were either not as effective or ineffective, usually resulted in precipitation of hydroxide in the solution and/or in the deposited films or prevented deposition of the RE or resulted in unacceptable appearing films.

Although the present invention has been described in considerable detail with reference to certain preferred versions and uses thereof, other versions and uses are possible. For example, other amino acids containing a single carboxyl group may be suitable complexing agents. Also, while only certain rare earth metals were evaluated, the techniques and principles set forth herein are believed to be suitable for the other rare earth metals, also referred to as lanthanides, which all have properties similar to lanthanum, as well as the actinides which are considered to be analogous to the lanthanides. Likewise other transition metals can also be used in the process described. Further, different combinations of the identified critical factors may also result in a suitable RE electroplate. For example, a higher or lower temperature may allow adjustment of the pH or Co/glycine ratio or a different Co/glycine ratio may allow using a different pH and temperature combination. It must be pointed out that only a single relevant condition was varied in the above reported tests while all other variables were kept constant. The reported experiments did not involve changing two variable at the same time to evaluate the effect of simultaneous variation of two or more variables. Therefore, the spirit and scope of the appended claims should not be limited to the description of the preferred versions contained herein.

What is claimed is:

1. A composition for enhancing the aqueous electrodeposition of rare earth metals comprising:

a water soluble salt of the rare earth metal, a water soluble salt of a transition metal, boric acid, and an amino acid.

2. The composition for enhancing the aqueous electrodeposition of rare earth metals of claim 1 wherein the water soluble salt of the rare earth metal is selected from the group consisting of chloride salts of cerium, lanthanum, neodymium, praseodymium, samarium, gadolinium, yttrium and mixtures thereof.

3. The composition for enhancing the aqueous electrodeposition of rare earth metals of claim 1 wherein the water soluble salt of the transition metal is selected from the group consisting of chloride salts of iron, nickel, cobalt and combinations thereof.

4. The composition for enhancing the aqueous electrodeposition of rare earth metals of claim 1 wherein the amino acid is selected from the group consisting of amine carboxylates, glycine, alanine, serine, malic, glycolic and lactic acids and combinations thereof.

5. The composition for enhancing the aqueous electrodeposition of rare earth metals of claim 1 wherein:

the water soluble salt of a rare earth metal is selected from the group consisting of chloride salts of cerium, lanthanum, neodymium, praseodymium, samarium, gadolinium, yttrium and mixtures thereof, the water soluble salt of a transition metal is selected from the group consisting of chloride salts of iron, nickel, cobalt and combinations thereof, and the amino acid is selected from the group consisting of amine carboxylates, glycine, alanine, serine, malic, glycolic and lactic acids and combinations thereof.

6. The composition for enhancing the aqueous electrodeposition of rare earth metals of claim 1 comprising:

0.3M of a water soluble salt of a rare earth metal selected from the group consisting of chloride salts of cerium, lanthanum, neodymium, praseodymium, samarium, gadolinium, yttrium and mixtures thereof, 0.12M of a water soluble salt of a transition metal selected from the group consisting of chloride salts of iron, nickel, cobalt and combinations thereof, and 0.36M of an amino acid selected from the group consisting of amine carboxylates, glycine, alanine, serine, malic, glycolic and lactic acids, and combinations thereof, and 0.5M of boric acid.

7. The composition for enhancing the aqueous electrodeposition of rare earth metals of claim 1, 2, 3, 4, 5 or 6 further including ammonium chloride.

8. A method for electrodepositing a metallic coating onto a metal substrate, said coating containing a rare earth metal comprising:

placing an aqueous solution containing a water soluble salt of the rare earth metal, a water soluble salt of a transition metal, boric acid, and an amino acid into a plating bath, placing an anode and the substrate to be coated into the bath and connecting the anode and the substrate to a DC power supply, with the substrate acting as the cathode, adjusting the pH of the bath to a suitable operating level, and applying a direct current through the anode and substrate causing the rare earth and the transition metal to migrate to, and adhere to, the substrate.

9. The method for electrodepositing a metallic coating onto a metal substrate of claim 8 wherein the water soluble salt of the rare earth metal is selected from the group consisting of chloride salts of cerium, lanthanum, neodymium, praseodymium, samarium, gadolinium, yttrium and mixtures thereof.

10. The method for electrodepositing a metallic coating onto a metal substrate of claim 8 wherein the water soluble salt of the transition metal is selected from the group consisting of chloride salts of iron, nickel, cobalt and combinations thereof.

11. The method for electrodepositing a metallic coating onto a metal substrate of claim 8 wherein the amino acid is selected from the group consisting of amine carboxylates, glycine, alanine, serine, malic, glycolic and lactic acids and combinations thereof.

12. The method for electrodepositing a metallic coating onto a metal substrate of claim 8 wherein:

the water soluble salt of a rare earth metal is selected from the group consisting of chloride salts of cerium, lanthanum, neodymium, praseodymium, samarium, gadolinium, yttrium and mixtures thereof, the water soluble salt of a transition metal is selected from the group consisting of chloride salts of iron, nickel, cobalt and combinations thereof, and the amino acid is selected from the group consisting of amine carboxylates, glycine, alanine, serine, malic, glycolic and lactic acids and combinations thereof.

13. The method for electrodepositing a metallic coating onto a metal substrate of claim 8 comprising providing:

0.3M of a water soluble salt of a rare earth metal selected from the group consisting of chloride salts of cerium, lanthanum, neodymium, praseodymium, samarium, gadoinium, yttrium and mixtures thereof, 0.12M of a water soluble salt of a transition metal selected from the group consisting of chloride salts of iron, nickel, cobalt and combinations thereof, and 0.36M of an amino acid selected from the group consisting of amine carboxylates, glycine, alanine, serine, malic, glycolic and lactic acids, and combinations thereof, and 0.5M of boric acid.

14. The method for electrodepositing a metallic coating onto a metal substrate of claim 8, 9, 10, 11, 12 or 13 further including ammonium chloride.

15. The method for electrodepositing a metallic coating onto a metal substrate of claim 8 wherein a DC current density from about 5 $mA/cm^2$ to about 20 $mA/cm^2$ is applied across the anode and cathode.

16. The method for electrodepositing a metallic coating onto a metal substrate of claim 8 wherein the pH of the solution is about 4.

17. The method for electrodepositing a metallic coating onto a metal substrate of claim 8 wherein the electrodeposition is conducted at room temperature.

18. The method for electrodepositing a metallic coating onto a metal substrate of claim 8 wherein the electrodeposition is conducted without stirring.

19. The method for electrodepositing a metallic coating onto a metal substrate of claim 8 wherein the electrodeposition is conducted with oscillatory stirring.

20. The method for electrodepositing a metallic coating onto a metal substrate of claim 8 wherein the electrodeposition is conducted with oscillatory stirring at a rate of 48 cycles/min.

* * * * *

UNITED STATES PATENT AND TRADEMARK OFFICE

CERTIFICATE OF CORRECTION

PATENT NO. : 6,306,276 B1 
DATED : October 23, 2001
INVENTOR(S) : Ken Nobe, Morton Schwartz, Linlin Chen and No Sang Myung It is certified that error appears in the above-identified patent and that said Letters Patent is hereby corrected as shown below:

Title page,
Insert Item [73] below Item [76], -- [73] Assignee: The Regents of the University of California. --

Signed and Sealed this

Seventeenth Day of December, 2002

JAMES E. ROGAN
*Director of the United States Patent and Trademark Office*